US006742817B2

(12) United States Patent
Timlin

(10) Patent No.: US 6,742,817 B2
(45) Date of Patent: Jun. 1, 2004

(54) METHOD OF CHARTING A RACECOURSE

(75) Inventor: Bryan Timlin, Birmingham, MI (US)

(73) Assignee: Imagine Pass L.L.C., Beverly Hills, MI (US)

( * ) Notice: Subject to any disclaimer, the term of this patent is extended or adjusted under 35 U.S.C. 154(b) by 0 days.

(21) Appl. No.: 09/915,882

(22) Filed: Jul. 26, 2001

(65) Prior Publication Data

US 2002/0185860 A1 Dec. 12, 2002

Related U.S. Application Data

(63) Continuation-in-part of application No. 09/875,609, filed on Jun. 6, 2001.

(51) Int. Cl.[7] ..... B42D 15/00

(52) U.S. Cl. ..... 283/67; 40/633; 283/75; 283/101; 283/117

(58) Field of Search ..... 40/630, 633; 283/56, 283/67, 70, 74, 75, 81, 101, 117; 700/91

(56) References Cited

U.S. PATENT DOCUMENTS 4,371,945 A * 2/1983 Karr et al. ..... 235/105
4,823,367 A * 4/1989 Kreutzfeld ..... 340/556
4,956,931 A * 9/1990 Selke ..... 119/858
4,991,337 A * 2/1991 Solon ..... 40/633
5,167,230 A * 12/1992 Chance ..... 356/41
5,654,685 A * 8/1997 Maul ..... 340/323 R
5,696,481 A * 12/1997 Pejas et al. ..... 340/323 R
5,704,067 A * 1/1998 Brady ..... 116/222
5,873,188 A * 2/1999 Gehris ..... 292/307 A
5,979,941 A * 11/1999 Mosher et al. ..... 235/378
6,349,493 B1 * 2/2002 Newman et al. ..... 40/633
6,441,846 B1 * 8/2002 Carlbom et al. ..... 348/169
2002/0198612 A1 * 12/2002 Smith et al. ..... 700/91

* cited by examiner

*Primary Examiner*—Monica S. Carter
(74) *Attorney, Agent, or Firm*—Howard & Howard

(57) ABSTRACT

A method of charting a race course comprises the steps of applying an adhesive fastener (116–118) on the strip (110) for adhesively interconnecting the first (112) and second (114) ends and disposing a column of marker indicia (120) extending along the strip (110) between the ends thereof with each marker indicia (120) signifying a mile marker along a course. The method includes the steps of forming the station indicia (122) to portray the availability of first aid, a toilet, and/or a prominent landmark along the course. A topographical outline (129) is formed to extend along the strip (110) parallel to the column of marker indicia (120) for indicating variances in elevation above sea level along the course. The back of the strip is formed with a legend and advertising indicia.

17 Claims, 1 Drawing Sheet

METHOD OF CHARTING A RACECOURSE

RELATED APPLICATION

This application is a continuation-in-part of co-pending application Ser. No. 09/875,609 filed Jun. 6, 2001.

BACKGROUND OF THE INVENTION

1. Field of the Invention

A wristband presenting information useful to a participant in a race such as a running marathon, a triathlon, bikeathon, etc.

2. Description of the Prior Art

While running a long marathon, e.g., twenty-six miles, a runner would like to have information readily available. The same applies to a participant in a triathlon or bikeathon. Obviously, a participant's clothing is sparse and unsuited for carrying such information. In pursuit of availability and carryability, wristbands have been used to present such information. One such wristband includes an elongated strip having first and second ends, an adhesive for interconnecting the first and second ends, and a column of mile marker numbers extending along the strip. Each strip is designated for an estimated total time for running the marathon and includes an accumulated elapsed time aligned across the strip with each mile marker number. The runner may look at the strip and compare actual elapsed time to the elapsed time at each mile marker on the strip to determine the difference between the actual and desired pace. Such a device provides a pace for finishing the race in a predetermined elapsed time.

However, it often occurs that the participant requires other information about the course while participating in the race. In addition, business entities that sell goods or services to people who participate in such races desire to advertise those goods and services to the participants. Likewise, it is necessary for the promoters of the race to raise money to support the race. A method is needed to bring these needs to resolution.

SUMMARY OF THE INVENTION AND ADVANTAGES

The invention provides a method of charting a race course comprising the steps of providing an elongated strip having first and second ends, positioning a fastener on the strip for interconnecting the first and second ends, and disposing a column of marker indicia extending along the strip between the ends thereof with each marker indicia signifying a distance along a course. The method is characterized by aligning station indicia across the strip with at least one of the marker indicia for indicating the location of a support station along the course.

In accordance with the method of this invention, the support stations may be provided by sponsors of the race who pay for the privilege of advertising on the wristband. The runners benefit by being able correlate their pace with the distance to various types of support stations while they are running by merely looking at their wrist.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
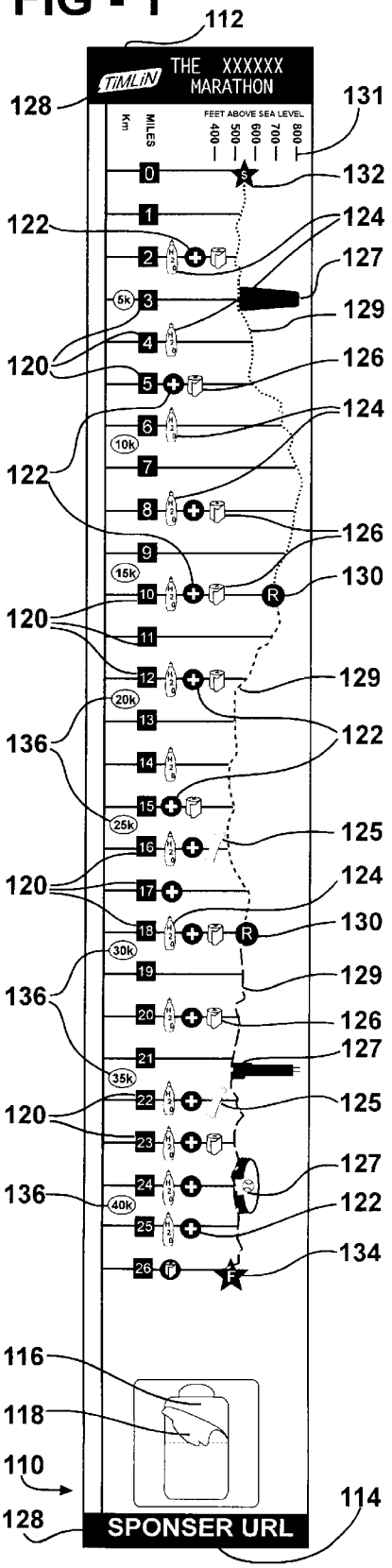
FIG. 1 is a plan view of a wristband constructed in accordance with the subject invention.
Figure 2:
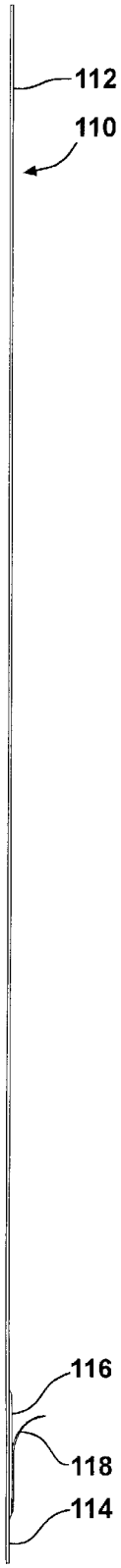
FIG. 2 is a side view of FIG. 1.

Referring to the Figures, wherein like numerals indicate like or corresponding parts throughout the several views, a wristband for use by a marathon runner, or a participant in a triathlon or bikeathlon comprises an elongated strip, generally indicated at (110), and having first (112) and second (114) ends.

A fastener in the form of an adhesive (116) and a removable cover (118) adhesively interconnects the first (112) and second (114) ends upon the strip (110) being wrapped around a wrist, i.e., placed in an endless loop. The adhesive (116) is applied to the second end (114) of the strip (110) and covered with a paper cover (118). The cover (118) may be peeled back to expose the adhesive (116) so that the adhesive (116) is placed against the other or first end (112) for fastening or securing the first (112) and second (114) ends together.

A vertically disposed column of marker indicia (120) extends along the strip (110) from top to bottom between the ends thereof with each marker indicia (120) signifying a distance along a course. More specifically, the marker indicia (120) comprise a column of mile marker numbers from zero to twenty-six extending along the strip (110) between the ends (112 and 114) thereof with each number signifying a mile marker along a course.

Station indicia are aligned across the strip (110) with at least one of the marker indicia (120) for indicating the location of a support station along the course. More specifically, the station indicia may comprise first aid station indicia (122) aligned across the strip (110) with at least one of the mile marker numbers (120) for indicating the availability of first aid. As illustrated, the first aid station indicia (122) is in form of a cross, the well-known cross for indicating first or medical aid. Alternatively or in addition, the station indicia may comprise supplement station indicia (124) aligned across the strip (110) with at least one of the mile marker numbers (120) for indicating availability of nutrients. As illustrated, the supplement marker indicia (124) comprise a bottle and is labeled with $H_2O$, the chemical symbol for water, and/or an energy bar (125). Also, the station indicia (126) may comprise a roll of toilet paper to portray the availability of a toilet. Yet another station indicia may be the likeness of a landmark (127), e.g., a prominent building in a city, a monument, a stadium, a bridge, etc.

Figure 3:
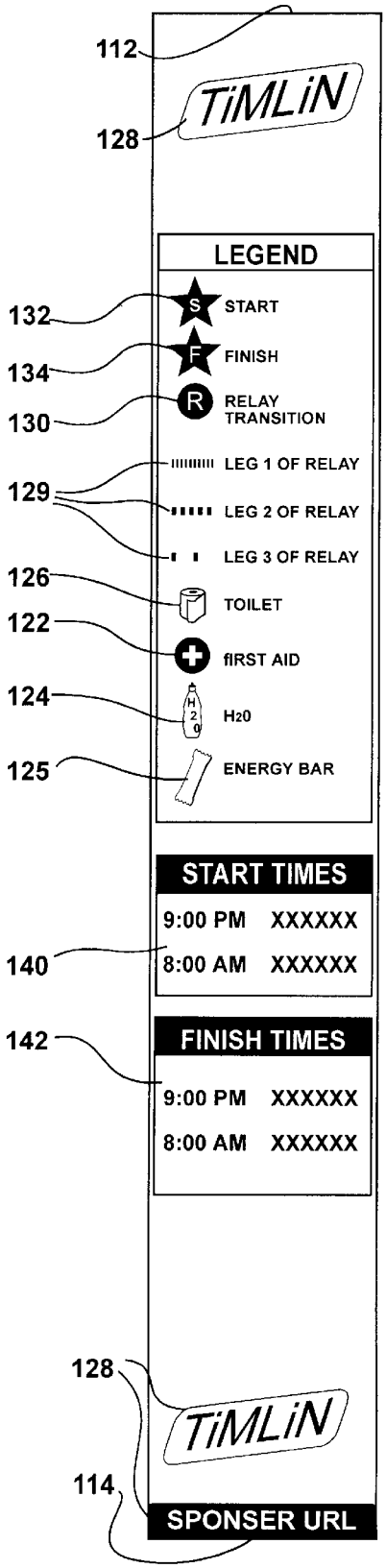
FIG. 3 is backview of FIG. 1 showing a legend of the indicia shown on the front face of the wristband.

The wristband (110) also includes advertising indicia (128) disposed at the first and second ends (112, 114) to identify a source for one of goods and services, or both. Of course, the advertising indicia (128) could be at either of the first (112) or second (114) ends and on the back, as shown in FIG. 3. However, the fastener (116–118) is disposed at the end of the strip (110) away from the advertising indicia (128) so that the advertising indicia (128) is exposed, i.e., on the end which overlaps the adhesive (116). The marker indicia (120), the support-station indicia (122, 124, 126, 127), and/or the advertising indicia 128 may be printed, embossed or separately secured on the strip (110).

A topographical outline (129) extends along the strip (110) parallel to the column of marker indicia (120) for indicating variances in elevation above sea level along the course. A scale (131) is disposed at one end of the topographical outline (129) to indicate the actual elevation above sea level. The topographical outline (129) is divided into relay sections by a relay transition indicator (130) aligned with predetermined ones of the marker indicia (120). The topographical outline (129) undulates between a start indicator (132) and a finish indicator (134) to indicate the uphill and downhill grades of the course.

In order to facilitate easy readability and understandability for runners familiar with different systems of measurement, i.e., miles or kilometers, a plurality of conversion indicia (136) are disposed in parallel relationship to the column of marker indicia (120) for converting the marker indicia (120) to the opposite of miles and kilometers. In other words, the column of marker indicia (120) may be in either miles or kilometers and the conversion indicia would be in the opposite of the miles or kilometers in the marker indicia (120).

As alluded to above, the back of the wristband (110) presents a legend of the symbols displayed on the front of the wristband (110). In addition, the backside provides the start times (140) and the finish time (142). Advertising space surrounds the legend.

As is known in the art, pace times may be added to indicate the elapsed time adjacent each marker (120) to show the runner how far off the desired total elapsed time the run is being made, i.e., whether the runner is ahead or behind the pace for a selected total time of running the race.

The invention provides a method of charting a race course comprising the steps of providing an elongated strip (110) having first (112) and second (114) ends, positioning a fastener (116–118) on the strip (110) for interconnecting the first (112) and second (114) ends, and disposing a column of marker indicia (120) extending along the strip (110) between the ends thereof with each marker indicia (120) signifying a distance along a course.

The method is characterized by aligning station indicia across the strip (110) with at least one of the marker indicia (120) for indicating the location of a support station along the course. The station indicia (122) may be formed to portray the availability of first aid. Or, the station indicia (124, 125) may be formed to portray the availability of nutrients. Additionally, the station indicia (126) may be formed to portray the availability of a toilet. Yet another station indicia may be formed to portray a prominent landmark (127) along the course.

The method may include disposing advertising indicia (128) at one of the first (112) and second (114) ends to identify one of goods and services and disposing the fastener (116–118) at the other end of the strip (110) from the advertising indicia (126).

The method includes disposing a topographical outline (129) extending along the strip (110) parallel to the column of marker indicia (120) for indicating variances in elevation above sea level along the course. Added to this is the step of disposing relay transition indicators (130) aligned with predetermined ones of the marker indicia (120).

The method includes disposing a plurality of conversion indicia (136) in parallel relationship to the column of marker indicia (120) for converting the marker indicia (120) to the opposite of miles and kilometers.

As alluded to above, the method includes disposing advertising indicia (128) on the strip to identify one of goods and services, collecting monies for the advertising indicia from the beneficiary of the advertising. Attendant to the step of the step of forming the station indicia to portray a prominent landmark (127) along the course is the step of collecting monies from the proprietor of the landmark. Of course, the method includes paying the race promoters a portion of the monies collected. The method concludes by distributing the strip (110) to participants in the race at the beginning of the racecourse.

Obviously, many modifications and variations of the present invention are possible in light of the above teachings. The invention may be practiced otherwise than as specifically described within the scope of the appended claims, wherein that which is prior art is antecedent to the novelty set forth in the "characterized by" clause. The novelty is meant to be particularly and distinctly recited in the "characterized by" clause whereas the antecedent recitations merely set forth the old and well-known combination in which the invention resides. These antecedent recitations should be interpreted to cover any combination in which the incentive novelty exercises its utility. In addition, the reference numerals in the claims are merely for convenience and are not to be read in any way as limiting.

What is claimed is:

1. A method of charting a race course comprising the steps of;

providing an elongated strip (110) having first (112) and second (114) ends, positioning a fastener (116–118) on the strip (110) for interconnecting the first (112) and second (114) ends, disposing a column of marker indicia (120) extending along the strip (110) between the ends thereof with each marker indicia (120) signifying a distance along a course, the method characterized by aligning station indicia across the strip (110) with at least one of the marker indicia (120) for indicating the location of a support station along the course and disposing a topographical outline (129) extending along the strip (110) parallel to the column of marker indicia (120) for indicating variances in elevation above sea level along the course.

2. A method as set forth in claim 1 including the step of forming the station indicia (122) to portray the availability of first aid.

3. A method as set forth in claim 1 including the step of forming the station indicia (124, 125) to portray the availability of nutrients.

4. A method as set forth in claim 1 including the step of forming the station indicia (126) to portray the availability of a toilet.

5. A method as set forth in claim 4 including disposing advertising indicia (128) at one of the first (112) and second (114) ends to identify one of goods and services.

6. A method as set forth in claim 5 including disposing the fastener (116–118) at the other end of the strip (110) from the advertising indicia (126).

7. A method as set forth in claim 1 including the step of forming the station indicia (127) to portray a prominent landmark along the course.

8. A method as set forth in claim 1 including the step of forming the station indicia (122) to portray the availability of first aid, forming the station indicia (124, 125) to portray the availability of nutrients, forming the station indicia (126) to portray the availability of a toilet, and forming the station indicia (127) to portray a prominent landmark along the course.

9. A method as set forth in claim 1 including a disposing relay transition indicators (130) aligned with predetermined ones of the marker indicia (120).

10. A method as set forth in claim 1 including disposing a plurality of conversion indicia (136) in parallel relationship to the column of marker indicia (120) for converting the marker indicia (120) to the opposite of miles and kilometers.

11. A method as set forth in claim 1 including distributing the strip (110) to participants in the race at the beginning of the racecourse.

12. A method as set forth in claim 1 including disposing advertising indicia (128) on the strip to identify one of goods and services, collecting monies for the advertising indicia from the beneficiary of the advertising.

13. A method as set forth in claim 12 including disposing advertising indicia (128) at one of the first (112) and second (114) ends to identify a source of one of goods and services.

14. A method as set forth in claim 12, paying the race promoters a portion of the monies collected.

15. A method as set forth in claim 1 including the step of forming the station indicia to portray a prominent landmark (127) along the course, collecting monies from the proprietor of the landmark.

16. A method as set forth in claim 1 including the step of forming the station indicia to portray a prominent landmark (127) along the course, collecting monies from the proprietor of the landmark.

17. A method of charting a race course comprising the steps of:

providing an elongated strip (110) having first (112) and second (114) ends, applying an adhesive fastener (116–118) on the strip (110) for adhesively interconnecting the first (112) and second (114) ends, disposing a column of marker indicia (120) extending along the strip (110) between the ends thereof with each marker indicia (120) signifying a mile marker along a course, forming station indicia (122) aligned with a marker indicia (120) to portray a location of first aid, forming station indicia (124, 125) aligned with a marker indicia (120) to portray a location of nutrients, forming station indicia (126) aligned with a marker indicia (120) to portray a location of a toilet, forming the station indicia (127) aligned with a marker indicia (120) to portray a location to a prominent landmark along the course, and forming a topographical outline (129) extending along the strip (110) parallel to the column of marker indicia (120) for indicating variances in elevation along the course.

* * * * *